US010598423B2

(12) United States Patent
Keller et al.

(10) Patent No.: US 10,598,423 B2
(45) Date of Patent: Mar. 24, 2020

(54) REFRIGERATOR WITH DISPENSER

(71) Applicant: BSH HAUSGERAETE GMBH, Munich (DE)

(72) Inventors: Hans Gerd Keller, Giengen (DE); Karl-Friedrich Laible, Langenau (DE); Florian Moertl, Neu-Ulm (DE); Senol Temizkan, Aalen (DE)

(73) Assignee: BSH Hausgeraete GmbH, Munich (DE)

( * ) Notice: Subject to any disclaimer, the term of this patent is extended or adjusted under 35 U.S.C. 154(b) by 46 days.

(21) Appl. No.: 15/417,297

(22) Filed: Jan. 27, 2017

(65) Prior Publication Data

US 2017/0227278 A1 Aug. 10, 2017

(30) Foreign Application Priority Data

Feb. 5, 2016 (DE) ..... 10 2016 201 782

(51) Int. Cl.

| | |
|---|---|
| ***F25D 23/02*** | (2006.01) |
| ***F25D 23/06*** | (2006.01) |
| ***B67D 1/00*** | (2006.01) |
| ***B67D 1/08*** | (2006.01) |
| ***F25D 23/12*** | (2006.01) |

(52) U.S. Cl.

CPC ..... *F25D 23/028* (2013.01); *B67D 1/0003* (2013.01); *B67D 1/0894* (2013.01); *F25D 23/064* (2013.01); *F25D 23/126* (2013.01); *F25C 2500/06* (2013.01); *F25D 2201/12* (2013.01)

(58) Field of Classification Search

CPC ..... F25D 23/028; F25D 23/04; F25D 23/064; F25D 2201/12; F25D 2331/806; F25D 2323/121; F25D 2323/122; F25D 2323/02; F25D 2323/023; F25D 2400/18; F25C 2500/06; A47F 3/043

See application file for complete search history.

(56) References Cited

U.S. PATENT DOCUMENTS 7,340,915 B2 * 3/2008 Kwon ..... F25D 23/02 62/324.4

FOREIGN PATENT DOCUMENTS

EP 2344820 B1 * 8/2012 ..... F25D 23/028

* cited by examiner

*Primary Examiner* — Edward F Landrum
*Assistant Examiner* — Chang H. Park
(74) *Attorney, Agent, or Firm* — Laurence A. Greenberg; Werner H. Stemer; Ralph E. Locher

(57) ABSTRACT

A refrigerator contains a dispenser for ice and/or liquid. A dispenser housing covers an opening in an outer shell of the refrigerator. The dispenser housing delimits a dispenser recess that extends outward and upward over an upper edge of the opening and is assembled from at least one main part, which extends from a lower edge of the opening over a rear wall to a front edge of a ceiling of the dispenser housing, and a filling part, which extends from the front edge to an upper edge of the opening.

13 Claims, 3 Drawing Sheets

REFRIGERATOR WITH DISPENSER

CROSS-REFERENCE TO RELATED APPLICATION

This application claims the priority, under 35 U.S.C. § 119, of German application DE 10 2016 201 782.9, filed Feb. 5, 2016; the prior application is herewith incorporated by reference in its entirety.

BACKGROUND OF THE INVENTION

Field of the Invention

The present invention relates to a refrigerator, in particular a domestic refrigerator, with a dispenser for ice and/or water.

Ice/water dispensers traditionally contain a dispenser housing, which is flush-mounted behind an opening in the outer shell in a heat-insulating wall of the refrigerator, usually a door, and delimits a dispenser recess in which a receptacle for filling with ice and/or liquid can be placed. Passages, via which ice and/or liquid pass into the dispenser housing, are located in an upper area of the dispenser housing.

To protect fittings such as valves or flaps, which are accommodated in the upper area of the dispenser housing to control the delivery of ice or liquid and/or to prevent unnecessary air circulation between the dispenser recess and the interior of the refrigerator via the passages, it is expedient to conceal this upper area. This may be done expediently by mounting an operating component at this location, via which the functioning of the dispenser can be controlled.

The number of buttons or other operating elements, which are required at least on the operating component in order to control the functions of the dispenser, is small and easily accommodated on an operating element, the level of which is lower than that of the fittings of the upper area, and in particular lower than the level of a flap on the output of an ice chute.

If the level of the operating element varies in different models of refrigerators, yet at the same time, independently of the level of the operating element, a receptacle can be placed just below an outlet such as the output of the ice chute or the end of a water conduit, in order to limit the dropping height of the ice or water and minimize the risk of splattering, then different versions of the dispenser housing are required depending on the level of the dispenser housing. The manufacture of several refrigerator models, which vary in the appearance of their dispenser, is thus expensive.

SUMMARY OF THE INVENTION

The object of the invention is to create a refrigerator with dispenser, which enables different refrigerator models to be produced cost-effectively.

The object is achieved in a refrigerator with a dispenser for ice and/or liquid. In the refrigerator a dispenser housing conceals an opening in an outer shell of the refrigerator and delimits a dispenser recess that extends outward and upward over an upper edge of the opening. The dispenser housing is assembled from at least one main part, which extends from a lower edge of the opening over a rear wall to a front edge of a ceiling of the dispenser housing, and a filling part, which extends from the front edge to an upper edge of the opening.

Since the filling part is provided at varying heights in different versions, a variable height of the operating component can be compensated so that the distance between a lower edge of the opening and the operating component or between the lower edge of the opening and an outlet of the dispenser can remain the same. Therefore only one identical model of main part, which can be produced cost-effectively in large quantities, is required for different models. The different models of filling components entail only relatively low costs due to their smaller dimensions and simpler construction.

The operating component is preferably mountable on an upper edge of the opening adjacently in the dispenser housing.

The filling part preferably contains a wall panel, which delimits the dispenser recess and is separated from the outer shell by a gap.

The filling part may also contain ridges, which extend to the outer shell. These ridges can be used for various purposes. Ridges on the edges of the wall panel can be used for fixing the filling part on the main part or delimiting the gap from the dispenser recess; ridges may be provided away from the edges in order to attenuate vibrations in them caused by contact with the outer shell or to control the penetration of foam into the gap when the housing of the refrigerator is filled with foam.

To prevent the outer shell sounding hollow when someone knocks on it at the level of the filling part, causing a user therefore to suspect an absence of insulation, the gap should be at least partially filled with foam.

To ensure that the foam to be forced into the gap when foam is filled from the outside is not prevented from advancing by counterpressure from air enclosed therein, the filling part may have a ventilation passage leading into the dispenser recess.

Such a ventilation passage should be sufficiently long and narrow so that, as soon as the foam has reached it and starts to be forced into it, the foam is held for long enough until it is set hard and solidified. Such a passage may expediently be located in a mandrel, which projects into the gap from the wall panel.

At least one of the aforementioned ridges may extend over the entire width of the wall panel and divide the gap into an upper, open-ended section and a lower section bounded on all sides.

When the upper section is filled with foam, the ridge forms an initial seal against the penetration of the foam. It does not have to be completely foam-tight, since the lower section of the gap can be used as a collection chamber for foam if necessary; the ridge only needs to delay the foam for long enough so that it hardens before the collection chamber is full.

A prefabricated insulation body, e.g. one that has been expanded in a hollow mold or customized from expanded material, may also be inserted into the gap, whether in order to be used as a seal against penetrating foam or merely to attenuate vibrations in it caused by contact with the outer shell.

To establish a foam-tight joint between the outer shell and the filling part, an edge strip of the outer shell angled on the upper edge of the opening can engage into a groove of the filling part.

An edge strip of the outer shell angled on a lateral or lower edge of the opening can engage accordingly into a groove of the main part.

A foam-tight joint between main part and filling part can be established by means of a tongue-and-groove joint.

The insertion direction of the tongue-and-groove joint is preferably oriented perpendicular to the outer shell. Thus the groove of the main part, which accommodates the flange of the outer shell, and the section of the tongue-and-groove joint, which is located on the main part, is molded with an identical molding tool and removed from the mold in the same movement.

In a particularly preferred manner, the section of the tongue-and-groove joint, which is located on the main part, is an upper area of a linear groove, the lower area of which accommodates the edge strip of the outer shell.

Other features which are considered as characteristic for the invention are set forth in the appended claims.

Although the invention is illustrated and described herein as embodied in a refrigerator with a dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
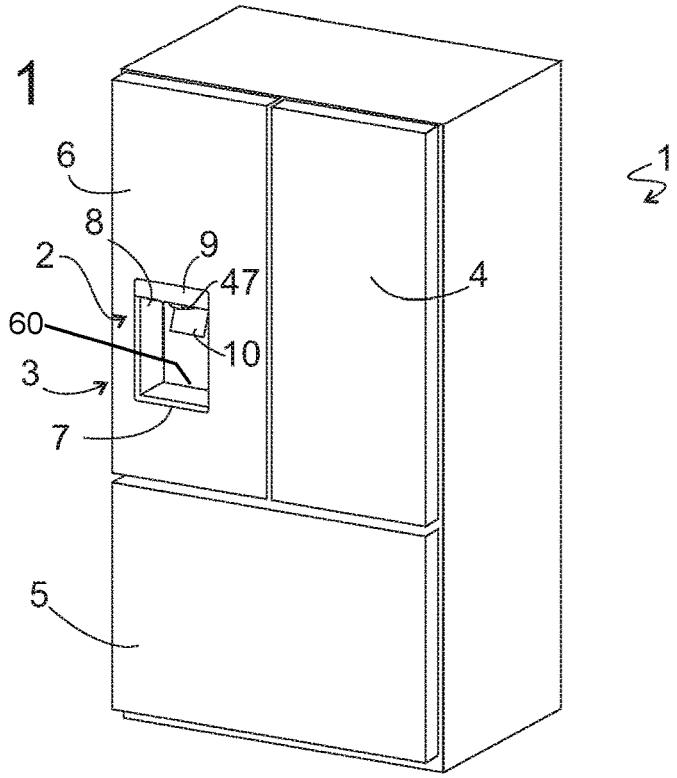
FIG. 1 is a diagrammatic, perspective external view of a refrigerator with a dispenser according to the invention.

Referring now to the figures of the drawings in detail and first, particularly to FIG. 1 thereof, there is shown a perspective external view of a refrigerator 1 with a dispenser 2 according to the present invention. The refrigerator 1 shown here is a combination appliance with double doors 3, 4, which together close a contiguous storage area, or which each close their own storage area, and a storage area formed below the double doors as a drawer 5. The dispenser 2 is flush-mounted into the door 3 in a manner that is known per se. For this purpose an opening 7, behind which a dispenser housing 8 is installed, is cut into a metallic outer shell 6 of the door 3. The dispenser housing 8 surrounds a dispenser recess 60, in which a receptacle to be filled with ice or water can be placed. An upper area of the opening 7 is occupied by an operating component 9, which, in the usual way, has buttons or other control elements (not shown in FIG. 1) for controlling the output of ice and/or water by the dispenser 2 and/or an operating status indicator. The operating component 9 conceals outlets for ice and water in an upper area of the dispenser recess 60. A filler tube 47, which is partially visible below the operating component 9, marks the position in which a receptacle can be placed for filling. Outlets for ice and water are arranged in a manner that is known per se above the filler tube 47 in such a way that dispensed ice only touches the inner surfaces of the filler tube on the way to the receptacle, and a dispensed water stream passes freely through the filler tube 47 without touching it. An operating paddle 10 on a rear wall of the dispenser housing 8 can be activated by the receptacle placed in the recess 60, in order to dispense ice or water into the receptacle.

Figure 2:
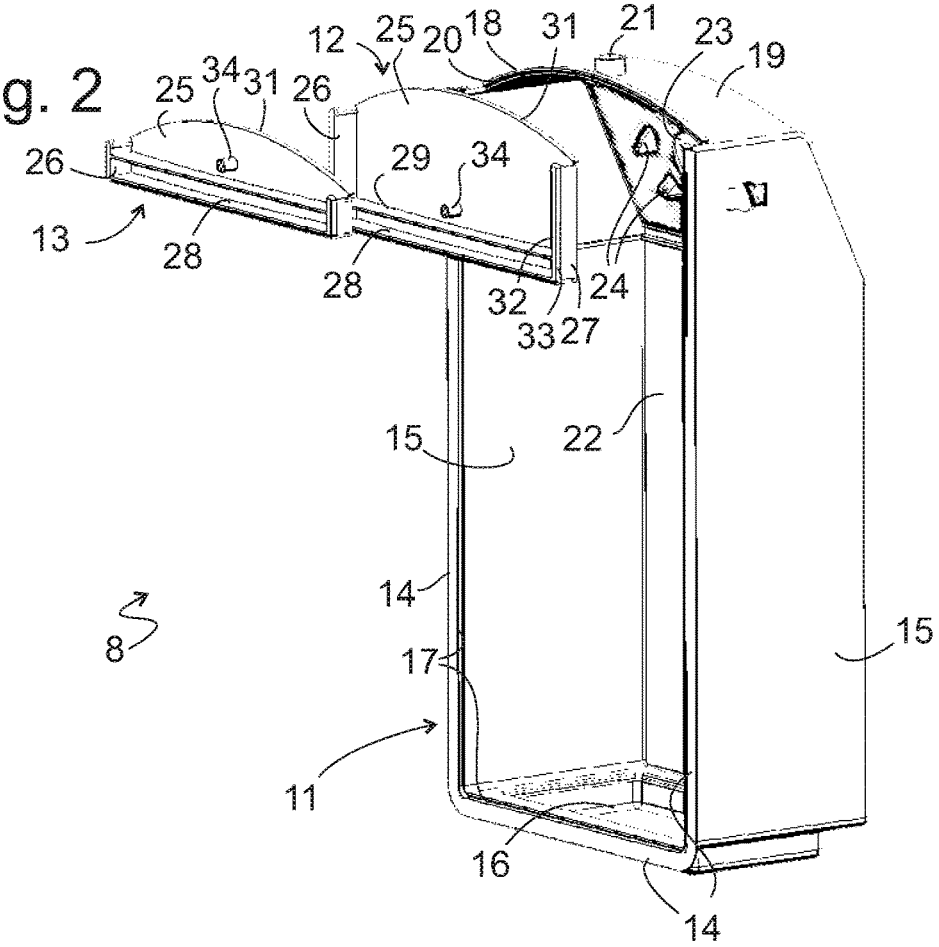
FIG. 2 is a perspective view of a main part and two different filling parts of a dispenser housing.

FIG. 2 shows a deconstructed perspective view of a main part 11 and two different filling parts 12, 13, which may optionally be assembled with the main part 11 to form the complete dispenser housing 8. The main part 11 is essentially shaped as a cuboid with the front side open. Front edges 14 of side walls 15 and a floor plate 16 of the main part 11 extend in the same vertical plane and are each provided with a groove 17 that opens to the front A front edge 18 of a ceiling 19 of the main part 11 is recessed against this plane. It is likewise provided with a groove 20 that is open toward the front. A passage is made in a vertex 21 of the ceiling 19, through which, in the fully assembled appliance, a water conduit is extended to an outlet in the upper area of the dispenser housing 8, above the filler tube 47. In an inclined wall section between the ceiling 19 and a rear wall 22, a hole 23 can be seen, which will form the outlet of an ice chute, as well as projections 24 for fastening a pivoting flap for closing the hole 23 when it is not in use.

The two filling parts 12, 13 are identical in terms of their construction; they differ only in the height at which they are located. A ridge 26, 27, 28 protrudes respectively along the lateral edges and the lower edge of a side of a vertical wall panel 25 facing toward the observer; a further ridge 29 parallel to the lower edge links the lateral ridges 26, 27. As can be seen more clearly in FIGS. 4, 5 and 6, a groove 30 is made in the edge of the lower ridge 28 facing toward the observer. A tongue 31 protrudes from an upper edge of the wall panel 25 on the side facing away from the observer. The function of a ventilation mandrel 34, which protrudes from the wall panel above the ridge 29, will be explained later.

The ridges 26, 27 are widened into a flange 32 on their edge facing toward the observer, from the rear side of which a tongue 33 in turn protrudes.

Figure 3:
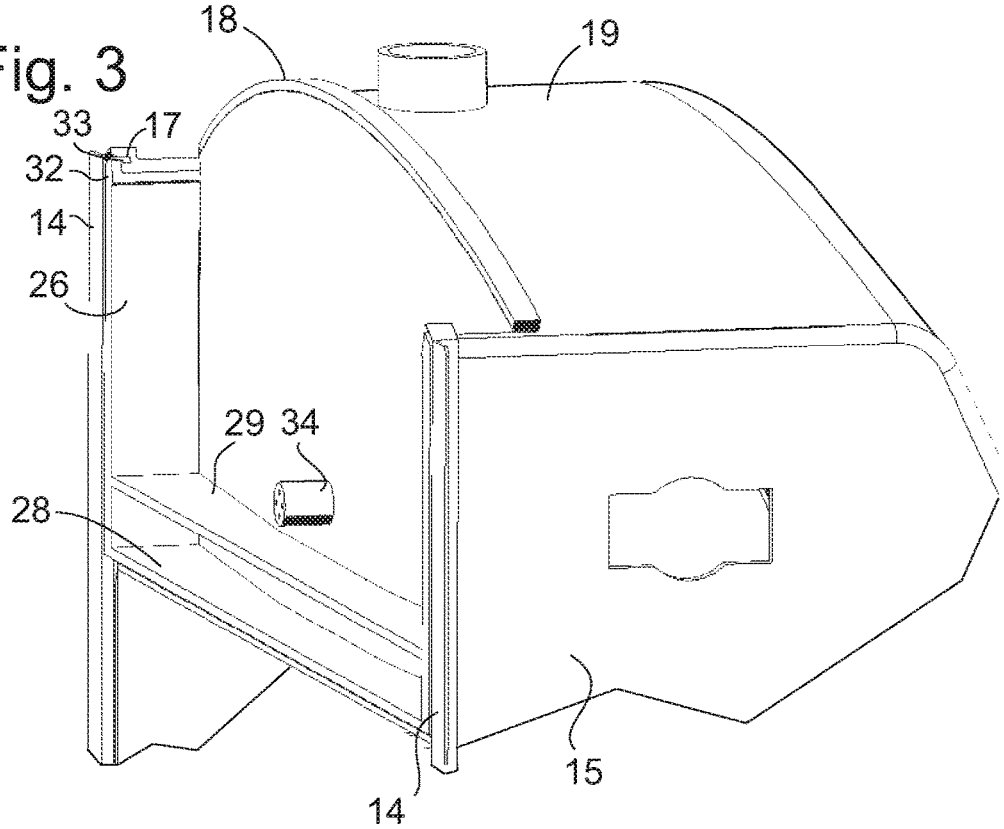
FIG. 3 is an enlarged, perspective partial view of the main part and an inserted filling part.

FIG. 3 is an enlarged view showing the upper area of the main part 11 and the filling part 12 joined to the main part 11 by the interlocking of the tongues and grooves in a direction perpendicular to the outer shell 6 and to the wall panel 25. The tongue 31 has disappeared into the groove 20 on the front edge 18 of the ceiling 19; the tongues 33 engage into the grooves 17 of the side walls 15. The interlocking can easily be seen here particularly on an angled upper end of the ridge 26. The flanges 32 and the vertices of the ridges 28, 29 are located on a plane with the front edges 14 of the side walls 15.

Figure 4:
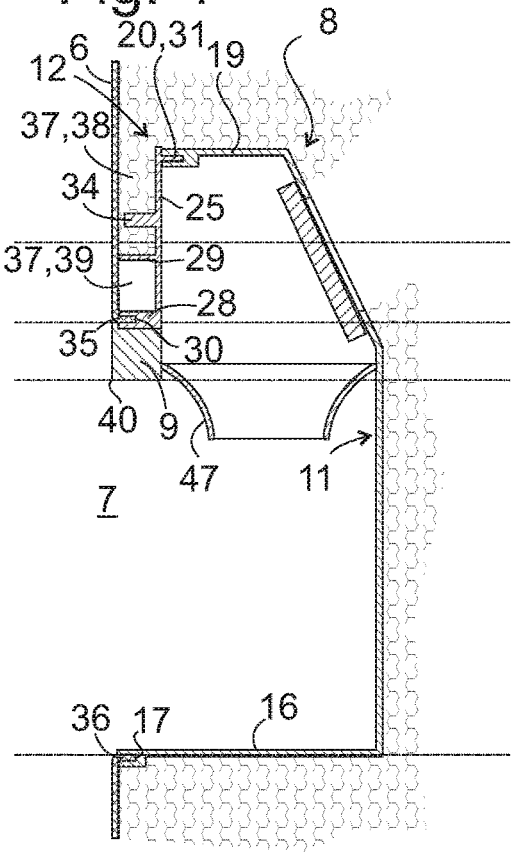
FIG. 4 is a sectional view through the door of a refrigerator with a small operating component.

FIG. 4 shows a vertical section through the dispenser housing 8 already installed in the door 3. An edge strip 35, 36 of the outer shell 6 on the upper and lower edge of the opening 7 is angled in each case toward the interior of the door. The lower edge strip 36 engages into the groove 17 at the front edge of the floor plate 16. The upper edge strip 35 engages into the groove 30 of the ridge 28. A gap 37 between the wall panel 25 and the outer shell 6 above the opening 7 is divided by the ridge 29 into an upper section 38 open at the top and a lower section 39 enclosed on all sides. When, following the installation of the dispenser housing 8 and the joining of the outer shell 6 to an inner wall (not shown) of the door 3, the cavity thus obtained is filled with foam, the foam can thus penetrate unimpeded from above into the upper section 38; to reach the lower section 39, however, is only possible if the ridge 29 does not rest closely against the outer shell 6 along its entire length. Any leakage of foam is precluded both on the upper edge of the wall panel 25 by the tongue 31 being engaged in the groove 20 and on its lower edge by the edge strip 35 being engaged in the groove 30.

The operating component 9 is installed directly below the ridge 28 and closes the opening 7 above an edge 40.

Figure 5:
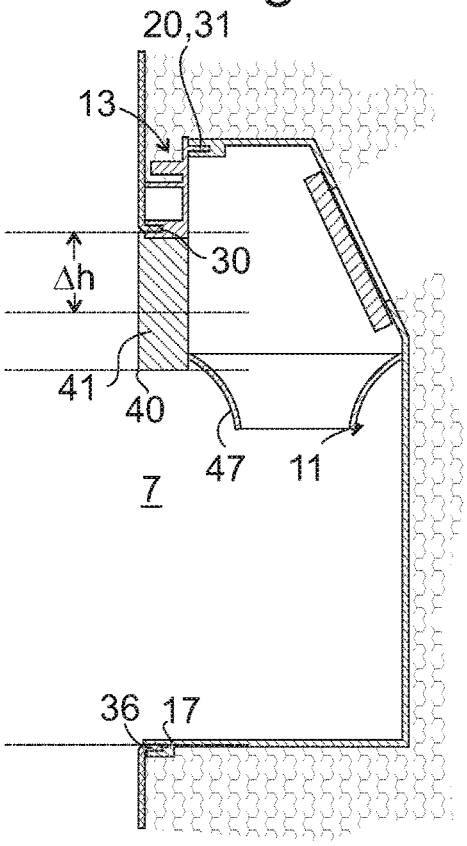
FIG. 5 is a sectional view through the door of a refrigerator with a large operating component.

FIG. 5 shows a section analogous to FIG. 4 through a dispenser housing with an operating component 41, the installation level of which is Δh higher than that of the operating component 9. The level of the opening 7 in the outer shell 6 is likewise increased by Δh; in contrast the distance between the groove 30 and the tongue 31 on the filling part 13 is Δh smaller than on the filling part 12, so that the useful level of the opening 7, between the edge 40 and the edge strip 36, is the same as in FIG. 4. The main part 11 is the same in both figures.

Figure 6:
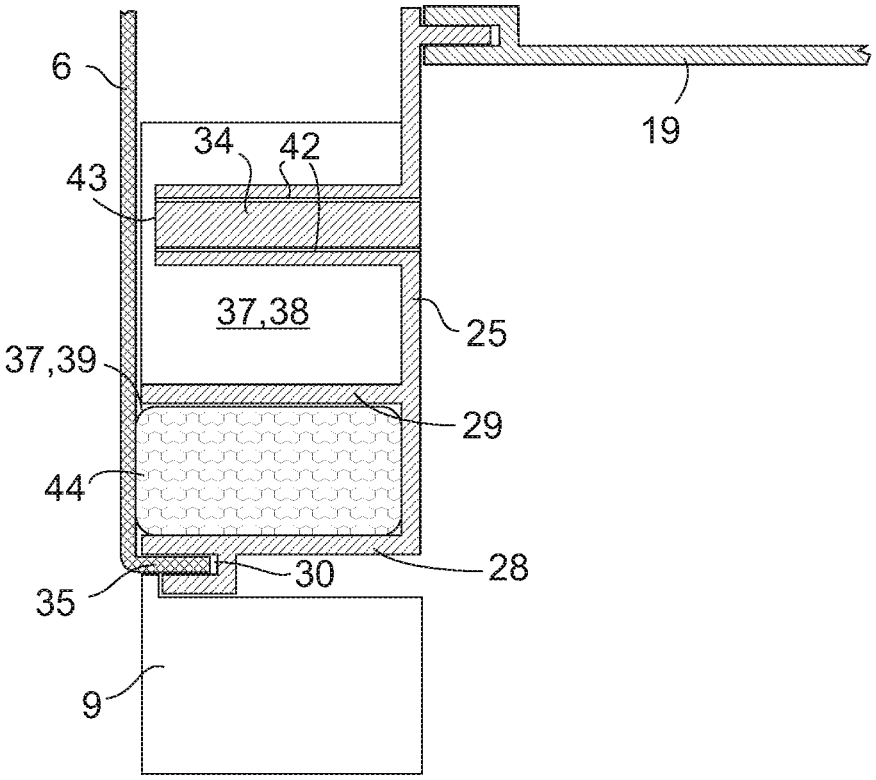
FIG. 6 is a vertical sectional view through an upper edge of an opening in an outer shell of the door and an area surrounding it.

FIG. 6 shows a further enlarged detail from FIG. 4. Narrow passages 42 can be seen here in the ventilation mandrel 34, which extend from a front surface 43 of the ventilation mandrel 34 opposite and at a short distance from the outer shell, through the wall panel 25 and into the dispenser recess. The air enclosed in the upper section 38 of the gap 37 can escape via these passages 42 while the foam is penetrating into the upper section 38. The small gap between the front surface 43 and the outer shell 6 ensures that the foam only advances to the front surface 43 when the ventilation mandrel 34 is completely surrounded by foam. The cross-section of the passages 42 is even smaller in comparison to the gap between front surface 34 and outer shell 6; if it is at or below the same order of magnitude as the bubble size of the foam, the foam cannot pass through the passages 42.

The pressure of the foam may cause the outer shell 6 to be pushed away from the ridge 29 slightly. To prevent the foam from penetrating over the ridge 29 and into the lower section 39, the latter can be filled in advance by insertion of a preformed insulation body 44, e.g. made from expanded polystyrene; it may however already be sufficient if the gap between the ridge 29 and the outer shell 6 is narrow enough to inhibit the penetration of the foam so that the quantity of foam passing through to constrict the gap is too small to fill the lower section 39.

Figure 7:
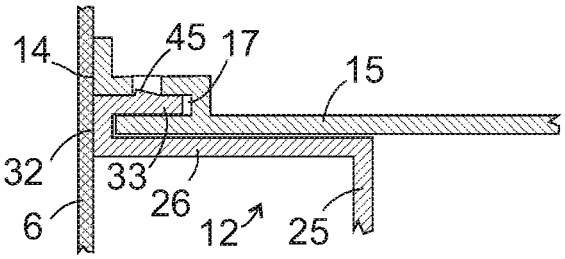
FIG. 7 is a horizontal sectional view through a lateral edge of the opening in the outer shell of the door at a level of the filling part.

FIG. 7 shows a horizontal section through the lateral ridge 26 and a section of the wall panel 25 of the filling part 12. The flange 32 and the front edge 14 of the side wall 15 rest against the outer shell 6. A latching projection 45 can be formed on the tongue 33, which securely interlocks the filling part 12 in the groove 17.

Figure 8:
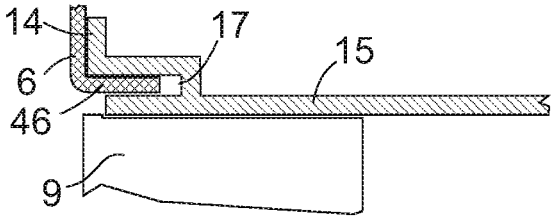
FIG. 8 is a horizontal sectional view through the lateral edge of the opening at the level of the operating component.

FIG. 8 shows a further horizontal section at the level of the opening 7 and of the operating component 9. As on the upper and lower edge of the opening, an edge strip 46 is also angled inwardly toward the interior of the door 3 on each of the lateral edges. The edge strip 46 engages into a lower area of the same groove 17, the upper area of which is filled by the tongue 32 of the filling part 12 as shown in FIG. 7. The length of the section of the groove 17, which is filled by one or the other, varies depending on the level of the opening 7 and of the filling part 12 or 13.

The following is a summary list of reference numerals and the corresponding structure used in the above description of the invention:

1 Refrigerator
2 Dispenser
3 Door
4 Door
5 Drawer
6 Outer shell
7 Opening
8 Dispenser housing
9 Operating component
10 Operating paddle
11 Main part
12 Filling part
13 Filling part
14 Front edge
15 Side wall
16 Floor plate
17 Groove
18 Front edge
19 Ceiling
20 Groove
21 Passage
22 Rear wall
23 Hole
24 Projection
25 Wall panel
26 Ridge
27 Ridge
28 Ridge
29 Ridge
30 Groove
31 Tongue
32 Flange
33 Tongue
34 Ventilation mandrel
35 Edge strip
36 Edge strip
37 Gap
38 Upper section
39 Lower section
40 Edge
41 Operating component
42 Passage
43 Front surface
44 Insulation body
45 Latching projection
46 Edge strip
47 Filler tube

The invention claimed is:

1. A refrigerator, comprising:

an outer shell having an opening formed therein;

a dispenser for at least one of ice or liquid and having a dispenser housing covering said opening, said dispenser housing delimiting a dispenser recess extending outward and upward over an upper edge of said opening in said outer shell;

an operating component mounted at said upper edge of said opening and in said dispenser recess;

said dispenser housing being assembled from at least one main part having a rear wall and a ceiling having a front edge, said at least one main part extending from a lower edge of said opening along said rear wall to said front edge of said ceiling of said at least one main part, wherein said front edge of said ceiling is disposed above an upper edge of said opening in said outer shell; and said dispenser housing further having a filling part filling at least a gap between said front edge of said ceiling of said at least main part and said operating component and extending behind said outer shell from said front edge of said ceiling of said at least one main part to said upper edge of said opening.

2. The refrigerator according to claim 1, wherein said filling part has a wall panel which delimits said dispenser recess and is separated from said outer shell by a gap.

3. The refrigerator according to claim 2, wherein said filling part has ridges which extend to said outer shell.

4. The refrigerator according to claim 3, wherein one of said ridges extends over an entire width of said wall panel and divides said gap into an upper, open-ended section and a lower section bounded on all sides.

5. The refrigerator according to claim 2, further comprising foam and said gap is at least partially filled with said foam.

6. The refrigerator according to claim 5, wherein said filling part has a ventilation passage formed therein and leading into said dispenser recess.

7. The refrigerator according to claim 6, wherein said dispenser has a mandrel projecting from said wall panel into said gap and said ventilation passage extends inside said mandrel.

8. The refrigerator according to claim 2, wherein said dispenser has a prefabricated insulation body inserted into said gap.

9. The refrigerator according to claim 1, wherein:

said filling part has a groove formed therein; and said outer shell has an edge strip disposed with respect to said upper edge of said opening and engages into said groove of said filling part.

10. The refrigerator according to claim 1, wherein:

said at least one main part has a groove formed therein; and said outer shell has an edge strip disposed with respect to a lateral or lower edge of said opening and is accommodated in said groove of said at least one main part.

11. The refrigerator according to claim 1, wherein said at least one main part and said filling part are connected by means of a tongue-and-groove joint.

12. The refrigerator according to claim 11, wherein a tongue of said tongue-and-groove joint is inserted into a groove of said tongue-and-groove joint in a direction perpendicular to said outer shell.

13. The refrigerator according to claim 11, wherein:

said outer shell has an edge strip;

said filling part has a tongue; and said at least one main part has a lower linear groove and an upper linear groove formed therein for accommodating said edge strip of said outer shell in said lower linear groove and said tongue of said filling part in said upper linear groove.

* * * * *